US005503645A

United States Patent [19]

Jung et al.

[11] Patent Number: 5,503,645

[45] Date of Patent: Apr. 2, 1996

[54] COMPOUND HAVING IMPROVED LOW TEMPERATURE FLUIDITY, AND A MIDDLE DISTILLATE COMPOSITION AND A PETROLEUM FUEL COMPOSITION CONTAINING THE SAME

[75] Inventors: Hyun-Jong Jung, Seoul; Bon-Cheol Ku; Ki-Ho Lee, both of Kyoungsangnam-do; Jin-Soo Lee, Seoul, all of Rep. of Korea

[73] Assignee: Yukong Limited, Seoul, Rep. of Korea

[21] Appl. No.: 247,702

[22] Filed: May 23, 1994

[51] Int. Cl.[6] ..... C10L 1/22

[52] U.S. Cl. ..... 44/418; 44/408; 44/393; 44/395; 44/397

[58] Field of Search ..... 564/156; 562/441, 562/442; 44/418, 408, 393, 395, 397

[56] References Cited

U.S. PATENT DOCUMENTS

| | | | |
|---|---|---|---|
| 3,250,715 | 5/1966 | Wyman | 252/56 |
| 3,264,216 | 8/1966 | Rockett et al. | 252/56 |
| 3,846,481 | 11/1974 | Gaydasch | 260/501.1 |
| 4,661,122 | 4/1987 | Lewtas | 44/408 X |
| 4,810,262 | 3/1989 | Lewtas et al. | 44/408 |
| 4,863,486 | 9/1989 | Tack et al. | 44/408 X |

OTHER PUBLICATIONS

CA Registry No. 116841–47–5 (no date).

CA Registry No. 93368–43–5 (no date).

*Primary Examiner*—Prince Willis, Jr.
*Assistant Examiner*—Cephia Toomer
*Attorney, Agent, or Firm*—Abelman, Frayne & Schwab

[57] ABSTRACT

The present invention improves the low temperature flow property of a fuel oil having a boiling point of 120°–150° C. by adding a novel compound prepared by reacting pri-, sec- or tert-aliphatic amine containing alkyl group of 1–30 carbon atoms with 9,10-dihydroanthracene-9,10-endo-α,β-succinic acid or anhydride thereof together with a polymer having ethylene structure and/or a terpolymer of dialkyl fumarate-vinyl ester-vinyl ether.

2 Claims, No Drawings

COMPOUND HAVING IMPROVED LOW TEMPERATURE FLUIDITY, AND A MIDDLE DISTILLATE COMPOSITION AND A PETROLEUM FUEL COMPOSITION CONTAINING THE SAME

The present invention relates to a compound having improved low temperature fluidity, and a middle distillate composition and a petroleum fuel composition containing the same.

BACKGROUND OF THE INVENTION

1. Field of the Invention

The present invention relates to a new compound for use as fuel oil additive and the method of preparing same for controlling the size of wax crystals formed in a low temperature fuel oil and preventing the cohesion of the wax crystals in a fuel oil, by using together with the wax crystal modifier and, more particularly, an amine salt or amide compound of following formula (I) prepared by reacting a pri-, sec- or tert-aliphatic amine containing alkyl group of 1–30 carbon atoms with 9,10-dihydroanthracene-9,10-endo-α,β-succinic acid or an anhydride thereof:

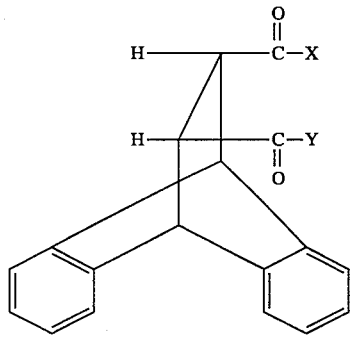

(I)

wherein, X is $NR_1R_2$ or $ONHR_3R_4R_5$ and Y is $NR_6R_7$ or $ONHR_8R_9R_{10}$ wherein $R_1$, $R_2$, $R_3$, $R_4$, $R_5$, $R_6$, $R_7$, $R_8$, $R_9$ and $R_{10}$ are hydrogen or straight chained alkyl group with 1–30 carbon atoms and they may be different or the same as each other, but all of them cannot be hydrogen.

2. Description of the Prior Art

Even a petroleum fraction with a high boiling point should be collected to obtain as much as possible of an amount of fuel oil from crude oil with moderate quality, containing large quantities of paraffin wax of high molecular weight by fractional distillation and thereby the paraffin wax of high molecular weight is increased in the fuel oil issuing from the process. The fuel oil has a feature in which the fluidity is decreased depending on the temperature decrease of the fuel oil, because the wax crystal extracted and grown in the fuel oil blocks a filter in a supply pipe and pipe arrangement in a diesel engine and thereby prevents the fuel oil from flowing.

There have been known many additives which act as wax crystal modifiers, added in wax-containing fuel oils to solve said problems. Said composition can modify the size and shape of the wax crystal and has the function of providing a fuel oil with fluidity even at a low temperature by improving the diffusion property of the wax crystal in a fuel oil.

Various pour point depressants, flow improvers, and fluidity improvers (hereinafter flow improvers) are disclosed in the literature and are commercially available. For instance, Korean Patent Publication No.91-4942 discloses a copolymer consisting of a vinyl ester of a carboxylic acid with a number average molecular weight of 1,000–6,000, containing 1–4 carbon atoms and ethylene, and 32–35 wt % of vinyl ester. British Patent No.1469016 shows the employment of a copolymer of di-n-alkyl fumarate and vinyl acetate as a co-additive, with ethylene-vinyl acetate copolymer to improve the low temperature fluidity of fuel oil with a high final boiling point. Polar compounds other than the copolymers aforementioned, which can suppress the growth of the wax crystal have been combined and used as ionic or non-ionic compounds. For example, U.S. Pat. No. 3,982,909 discloses that dicarboxylic acid or amine salt and/or amide of dicarboxylic monoester, obtained by reacting maleic anhydride with hydrogenated tallow amine is co-added together with flow improvers of ethylene structure, as an additive for middle distillate fuel oil. U.S. Pat. No. 4,402,708 discloses amine salt and/or amide, a resultant of the reaction with phthalic acid or anhydride thereof and sec-aliphatic amine containing 16–40 carbon atoms.

The inventors accomplished the present invention, on the basis that nitrogen-containing polar compounds, other than the flow improvers mentioned in the above prior art, can be used with a polymer having an ethylene structure and/or a terpolymer of dialkyl fumarate-vinyl ester-vinyl ether to improve the fluidity of a fuel oil and a wax diffusion property in a fuel oil.

SUMMARY OF THE INVENTION

In accordance with one aspect of the invention, there is provided a novel compound which is an amine salt or an amide compound of following formula (I) and a method of preparing same prepared by reacting pri-, sec- or tert-aliphatic amine containing alkyl group of 1–30 carbon atoms with 9,10-dihydroanthracene-9,10-endo-α,β-succinic acid or anhydride thereof for improving the fluidity and the wax diffusion property of fuel oil coming out from crude oil, boiling at a temperature of 120°–500° C.

In accordance with another aspect of the invention, there is provided a fuel oil in which the fluidity and wax diffusion property are improved, containing 10–1000 ppm of amine salt or amide compound of following formula (I) prepared by reacting pri-, sec- or tert-aliphatic amine containing alkyl group of 1–30 carbon atoms with 9,10-dihydroanthracene-9,10-endo-α,β-succinic acid or anhydride thereof.

In accordance with another aspect of the invention, there is provided a middle distillate composition with improved fluidity and wax diffusion property by mixing a nitrogen-containing polar compound together with a polymer having and ethylene structure and/or a terpolymers of dialkyl fumarate-vinyl ester-vinyl ether.

In accordance with another aspect of the invention, there is provided a fuel oil with improved fluidity and wax diffusion property, containing 0.002–4.0 wt % of said middle distillate composition in accordance with the present invention.

DETAILED DESCRIPTION OF THE PREFERRED EMBODIMENTS

The novel nitrogen-containing polar compound of the present invention of formula (I) below for accomplishing the objects is an amine salt or an amide compound prepared by resulted by reacting pri-, sec- or tert-aliphatic amine containing alkyl group of 1–30 carbon atoms with 9,10-dihydroanthracene-9,10-endo-α,β-succinic acid or anhydride thereof:

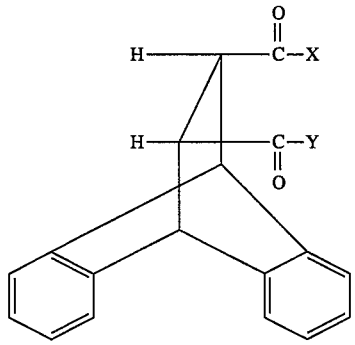

(I)

wherein, X is $NR_1R_2$ or $ONHR_3R_4R_5$ and Y is $NR_6R_7$ or $ONHR_8R_9R_{10}$ wherein $R_1$, $R_2$, $R_3$, $R_4$, $R_5$, $R_6$, $R_7$, $R_8$, $R_9$ and $R_{10}$ are hydrogen or straight chained alkyl group with 1–30 carbon atoms and they may be different or the same with each other, but all of them cannot be hydrogen.

In the formula (I), diamine salt wherein X is $ONHR_3R_4R_5$ and Y is $ONHR_8R_9R_{10}$, may be derived from pri-, sec- or tert-aliphatic amine, whereas diamide wherein X is $NR_1R_2$ and Y is $NR_6R_7$, and half amine half amide wherein X is $NR_1R_2$ and Y is $ONHR_8R_{10}$ may only be derived from pri- or sec-amine. The available amine for preparing the compound of the formula (I) is pri-, sec- or tert-amine containing long chained alkyl groups of 8 to 30 carbon atoms and mixture thereof, but among the amine with short chained carbon, the nitrogen compound which is dissolved in a fuel oil can also be used. The preferable amine may include pri-, sec- or tert-amine and more preferable amine is a sec-amine of formula $HNR_5R_6$ wherein $R_5$ and $R_6$ are alkyl group containing 1 to 30 of carbon atoms, more preferably 8 to 24 of carbon atoms and they may be either same or different. Some examples of the amine are ditetradecyl amine, dihexadecyl amine, dioctadecyl amine and dibihenyl amine and so on. Amine mixtures may be available in the present invention and amines coming out from nature are almost mixtures. The examples of the amine mixtures are dicoco amine or hydrogenated tallow amine.

9,10-dihydroathracene-9,10-endo-α,β-succinic acid or anhydride thereof for preparing the compound of the formula (I) is prepared by obtaining the anhydride by heating anthracene and maleic anhydride in an aromatic solvent such as benzene, toluene and xylene at a temperature of 80°–140° C. and hydrolyzing said anhydride with an acid or base catalyst.

Half amide.half amine wherein X is $NR_1R_2$ and Y is $ONHR_8R_9R_{10}$ can be easily prepared by reacting 1 mole of 9,10-dihydroanthracene-9,10-endo-α,β-succinic anhydride and 2 mole of dialkylamine. It is preferable to use the aromatic solvent used in preparation of the 9,10-dihydroanthracene-9,10-endo-α,β-succinic anhydride and the reaction is carried out at a temperature of 5°–120° C., more preferably at a temperature of 40°–85° C.

Another preferable compound, diamide wherein X is $NR_1R_2$ and Y is $ONR_6R_7$ is prepared by heating said half amide.half amine salt and removing water. Another preferable compound of diamine salt wherein X is $ONHR_3R_4R_5$ and Y is $ONHR_8R_9R_{10}$ can be prepared by simply mixing 1 mole of 9,10-dihydroanthracene-9,10-endo-α,β-succinic acid and 2 mole of dialkylamine. Though the three methods refer to amine salt and/or amide in a neutralized form which are obtained by reacting 2 moles of dialkylamine, the amine salt and/or amide could be partially neutralized or exist with the excess amount of amine.

To accomplish another object of the invention, a fuel oil with improved fluidity and wax diffusion property is provided by achieving a fuel oil which comprises 10–1,000 ppm of nitrogen-containing polar compound of the formula (I).

The fuel oil with improved fluidity and wax diffusion property for accomplishing another object of the invention comprises 0.002–4.0 wt % of a middle distillate composition comprising nitrogen-containing polar compound of formula (I) together with a polymer having ethylene structure and/or terpolymer of dialkyl fumarate-vinyl ester-vinyl ether.

The polymer having ethylene structure is ethylene-vinyl ester copolymer, and preferably contains 5–50 wt %, preferbly 10–40 wt % of vinyl acetate as vinyl ester. It could be a mixture of two copolymers disclosed in Korean Patent Publication No. 91-4942. The copolymers with 1,000–10,000, preferably 1,000–5,000 of a number average molecular weight by the measurement with vapour pressure osmometer are available.

The middle distillate composition contains a terpolymer of dialkyl fumarate-vinyl ester-vinyl ether and more particularly, includes a terpolymer with 1,000–10,000 of a number average molecular weight, comprising 50–90 wt % of ester of monoalcohol with 1–24 carbon atoms, preferably 4–18 and dicarboxylic acid with carbon atoms 4, 5–45 wt % of ethylenically unsaturated mono ester with 3–6 carbon atoms and 5–45 wt % of ethylenically unsaturated ether with 3–24 carbon atoms.

Dicarboxylic alkyl ester, the first constitute for preparing the terpolymer is represented as following formula (II):

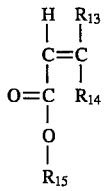

(II)

wherein, $R_{14}$ is $COOR_{16}$ when $R_{13}$ is hydrogen, $R_{13}$ is $COOR_{16}$ when $R_{14}$ is hydrogen and $R_{15}$ or $R_{16}$ is hydrogen or straight chained alkyl with 1–24 carbon atoms in which they may be either same or different, but all of them cannot be hydrogen.

Dicarboxylic alkyl ester can be prepared by esterifying a dicarboxylic acid with suitable alcohol or alcohol mixture. The preferable dicarboxylic alkyl ester of the formula (II) is di-n-butyl-fumarate, di-n-tetradecyl fumarate, di-n-hexadecyl fumarate, di-n-octadecyl fumarate, di-n-bihenyl fumarate, di-n-dodecyl maleate, di-n-tetradecyl maleate, di-n-hexadecyl maleate. Dialkyl fumarate or dialkyl maleate in terpolymer is in the range of 50–90 wt %, preferably 70–90 wt %, and more preferably 86 wt %.

Dicarboxylic alkyl ester of the formula (II) is polymerized with various amounts of ethylenically unsaturated aliphatic monoester and ethylenically unsaturated ether, for example 5–45 wt % of ethylenically unsaturated aliphatic monoester of the formula (III) and 5–45 wt % of ethylenically unsaturated ether of the formula (IV).

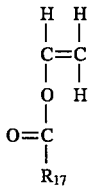

(III)

-continued

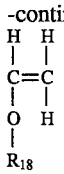

(IV)

In formula (III), $R_{17}$ is hydrogen, or straight chained or branched chain alkyl with 1–4 carbon atoms. The preferable examples for short chained esters are vinyl acetate, vinyl propionate and isoprophenyl acetate. The amount of vinyl ester in the terpolymer is 5–45 wt %, preferably 5–15 wt % and most preferably 7 wt %.

In formula (IV), $R_{18}$ is straight chained or branched chain alkyl with 1–22 carbon atoms. The preferable examples of alkyl vinyl ether are methyl vinyl ether, ethyl vinyl ether, propyl vinyl ether and butyl vinyl ether. The amount of alkyl vinyl ether is 5–45 wt %, preferably 5–15 wt % and more preferably 7 wt %.

The terpolymer has 1,000–5,000 of a number average molecular weight in which dicarboxylic acid is fumaric acid, ethylenically unsaturated aliphatic monoester with 3–6 carbon atoms is vinyl acetate and ethylenically unsaturated ether with 3–24 carbon atoms is butyl vinyl ether.

The solvents generally used in the polymerizing steps for preparing the terpolymer are hydrocarbon solvents, such as hexane, cyclohexane, n-heptane, n-octane, benzene, toluene and xylene. The initiator for polymerizing is peroxide, such as benzoyl peroxide, tert-butyl hydroperoxide, di-tert-butyl peroxide and cumene peroxide, or azobis-iso-butyronitrile. Azobis-iso-butyronitrile is, especially, the most preferable initiator for preparing a terpolymer with a molecular weight range which can improve the fluidity excellently. The polymerizing temperature is 5°–150° C. and more preferably 60°–80° C. The polymerizing pressure is 1–5 atm and more preferably 1 atm.

The reaction is carried out in a reaction apparatus, putting solvent, di-n-tetradecyl fumarate, vinyl acetate, n-butyl vinyl ether and initiator and heating up to a reaction temperature under nitrogen gas. The polymerizing time is 1–30 hours. The resultant from the reaction is distillated to remove solvent, vinyl acetate and n-butyl vinyl ether under reduced pressure.

The nitrogen-containing polar compound, used as an additive in the present invention, can be used along with a polymer having an ethylene structure and/or the terpolymer of dialkyl fumarate-vinyl ester-vinyl ether to produce a middle distillate composition with improved fluidity and wax diffusion property. The ratio of the two-constituent mixture (the nitrogen-containing polar compound: the polymer having ethylene structure or the terpolymer) is preferably 20:1–1:20 by weight, more preferably 10:1–1:10 by weight, and most preferably 4:1–1:4 by weight. The three-constitute mixture (the nitrogen-containing polar compound, the polymer having ethylene structure and the terpolymer) also can be used and the ratio of nitrogen-containing polar compound: polymer having ethylene structure: terpolymer of dialkyl fumarate-vinyl ester-vinyl ether is preferably 1 20–0.05:20–0.05, more preferably 1:10–0.1:10–0.1 and most preferably 1:4– 0.25:4–0.25 by weight.

Additives in the present invention, namely, the nitrogen-containing polar compound, said two-constituent mixture or said three-constituent mixture, can be a concentrate in the solvent suitable for applying in distillated fuel. The concentrate is dissolved easily in suitable solvent to be comprised of 5–90 wt %, more preferably 10–70 wt % and most preferably 20–60 wt % of the additives. The concentrate is also available in the present invention. The suitable solvent is a stable inert organic solvent with 80°–400° C. of a boiling point, such as benzene, toluene, xylene, kerosene, and aromatic naphtha and most preferably aromatic naphtha of 7–11 carbon atoms with 140°–200° C. of a boiling point. It is preferable to add an antioxidant such as nonylphenol to enhance the storage stability of the concentrate.

The amount of said two-constitute or three-constituent mixture (middle distillate composition) being contained in the fuel oil according to the present invention depends on the kind of the fuel oil but is usually 0.002–4.0 wt % based on the weight of the fuel oil, for example, 0.002–0.1 wt % of the above additive in the concentrate for whole fuel oil. And the amount of polymer having ethylene structure or terpolymer of dialkyl fumerate-vinyl ester-vinyl ether in said middle distillate composition being contained in the fuel oil is 0.002–0.2 wt % based on the weight of the fuel oil.

The additives can be added to any conventional fuel oil, preferably fuel oil with a boiling point of 120°–500° C., especially 140°–400° C.

The present invention is illustrated in the following examples in detail but the scope of the invention is not limited by the following examples and various modification and changes are also included in the present invention.

Preparation Example

Each additive available in the following examples were prepared by the following methods.

Additive A: N,N-dioctadecyl 9,10-dihydroanthracene-9,10-endo-α,β-succinamic acid N,N-dioctadecyl ammonium salt 10.44 g of dioctadecyl amine and 100 ml of toluene were heated in 250 ml of a three-necked flask equipped with a reflux condenser and a thermometer, up to 50° C. After stopping the heating on melting of the whole solid, 9,10-dihydroanthracene-9,10-endo-α,β-succinic anhydride was put and stirred continuously. White crystal was produced, keeping overnight a room temperature after succinic anhydride was melt completely. The solution was distillated under pressure to remove toluene and obtain 12.9 g of additive A with a boiling point of 80.0°–83.0° C.

Additive B

Addditive B is a mixture of AC-430(Allamit Chemical Co. of USA, a number average molecular weight: 3,000, the ratio of vinyl acetate: 23–30 wt %) and AC-400(Allamit Chemical Co. of USA, a number average molecular weight: 6,500, the ratio of vinyl acetate: 13 wt %), ethylene-vinyl acetate copolymer, in a ratio of 3:1 by weight.

Additive C

Additive C is a terpolymer having 3,000 of a number average molecular weight (Gel Permeation Chromatography, polyethylene glycol standard) prepared by heating a mixture of 5.09 g (50 mol %) of di-n-tetradecyl fumarate, 0.69 ml (37.5 mol%) of vinyl acetate, 0.33 ml (12.5 mol %) of n-butyl vinyl ether and 98.5 mg of azobis-iso-butyronitrile at 65°–70° C. for 18.5 hours under nitrogen gas for polymerization.

Additive D

Addditive D is a terpolymer having 3,500 of a number average molecular weight prepared with a mixture of 5.09 g (50 mol %) of di-n-tetradecyl fumarate, 0.23 ml (12 mol %) of vinyl acetate, 0.99 ml (37.5 mol %) of n-butyl vinyl ether and 98.5 mg of azobis-iso-butyronitrile by the same method with the additive C.

Additive E (Comparative compound)

Additive E is half amine half amide prepared with phthalic anhydride and dioctadecyl amine in accordance with Example 1 disclosed in U.S. Pat. No. 4,402,708.

Additive F (Comparative flow improver)

Additive F is a lower temperature flow improver of PF-418, Exxon Chemica Co. of USA, which is a mixture of ethylene-vinyl acetate copolymer, dialkyl fumarate-vinyl acetate copolymer, and half amine half amide prepared with phthalic anhydride and dioctadecylamine.

The characteristics of the fuel oil used for testing the flow improving properties of the above additives at a low temperature are as follow:

TABLE 1

| Property | | Fuel oil I | Fuel oil II |
|---|---|---|---|
| Distillation Characteristics (°C.) | IBP* | 159 | 161 |
| | 10% BP** | 196 | 193 |
| | 20% BP | 212 | 213 |
| | 50% BP | 261 | 268 |
| | 90% BP | 338 | 342 |
| | FBP*** | 368 | 377 |
| PP**** | | −7.5 | −12.5 |
| CFPP***** | | −1 | −3 |
| Cloud Point | | +4 | −1 |

*Initial Boiling Point
**Boiling Point
***Final Boiling Point
****Pour Point
*****Cold Filter Plugging Point The distillation characteristics were measured by ASTM D86 and the cloud point was determined by ASTM D2500. The pour point of the fuel oil was determined by ASTM D97 and the fluidity of the fuel sample was tested by inclining or turning the sample per 2.5° C. The fluidity difference between the fuel having an additive and the fuel without an additive is regarded as a pour point drop due to an additive. The more effective pour point depressant shows much larger dropping in pour point at the same concentration of the additive. The size of wax crystal at a rapid cooling of the fuel is tested by Cold Filter Plugging Point (CFPP) and the test is accomplished with 45 ml of oil sample to be tested, in accordance with the method in "Journal of the Institute of Petroleum", pp 173–185, No. 510, Vol 52 , June 1966.

The oil in ASTM cloud point jar was cooled in a bath maintained at about −30° F. The oil was sent into a pipette marked to 20 ml on absorbing 8 in. of water through a filter equipping a screen of 350 mesh per 1° C. dropping at 4° C. of starting temperature, above the cloud point and the oil got back due to gravity to flow into a cooling room, concurrently. The test was repeated until the pipette was not filled with the oil to the mark within 60 sec. The result was recorded as Cold Filter Plugging Point and was the highest temperature not filling the pipette with oil. The CFPP difference between the oil having an additive and the oil without an additive was recorded as a CFPP depression due to an additive. The more effective flow improver shows much larger CFPP depression at the same concentration of the additive.

The wax settling was tested as a method to determine effectiveness of a flow improver. 500 ml of fuel composition mixed with an additive was put into a thermostat maintained at 45° C. for at least 20 min. and 45 ml of it was placed in ASTM cloud point jar. The prepared sample was cooled slowly by 1°–6° C. per hour and finally maintained at a temperature of −15°– −20° C. for 24–48 hours. The size of the settling layer was determined by measuring the volume of the muddy fuel visually and "Wax Dispersion Index" was determined in percentage of said volume to total volume of the fuel. Low percentage means severe wax settling and 100 means a fuel fluid without settling. Notably, since the fuel gelled by big wax crystal always reveals high percentage value, this result should be recorded as "gel". Two wax layers are expressed as, for example "95/5". The size of crystal is represented as "large", "medium" and "small" by observing the size during elevating the temperature slowly by placing the cooled sample at room temperature. The "wax redissolving time" was recorded by measuring the time the whole wax dissolves to become a homogeneous solution.

EXAMPLE 1

The additives A and E were added in the fuel I and the results were listed in the following Table 2.

TABLE 2

| | | | Fuel I | | | | |
|---|---|---|---|---|---|---|---|
| No. | AD.* | Amount (ppm) | CFPP* (ΔCFPP) (°C.) | P.P.* (ΔP.P.) (°C.) | W.D.I.* (%) | C.S.* | W.R.T.* (min/sec) |
| 1 | A | 300 | −4(3) | −37.5(30) | 100 | large | 11/25 |
| 2(a)* | E | 300 | −5(4) | −20.0(12.5) | 50/50 | large | 11/25 |

*AD.: Additive
(a): Comparative Example
ΔCFPP: CFPP depression
ΔP.P.: Pour Point depression
W.D.I.: Wax Dispersion Index
C.S.: Crystal Size
W.R.T.: Wax Redissolving Time The data shows the additive A in accordance with the present invention is more effective than the comparative additive E.

EXAMPLE 2

The properties of the fuel oil I and II including additive A, additive B and/or additive C were listed in the following Tables 3 and 4.

TABLE 3

Fuel I

| No. | AD.* | Amount (ppm) | CFPP* (ΔCFPP) (°C.) | P.P.* (ΔP.P.) (°C.) | W.D.I.* (%) | C.S.* | W.R.T.* (min/sec) |
|---|---|---|---|---|---|---|---|
| 3 | A | 63 | −17(16) | −25.0(17.5) | 100 | small | 9/50 |
| | B | 158 | | | | | |
| | C | 79 | | | | | |
| 4 | A | 63 | −14(13) | −25.0(17.5) | 100 | small | 9/40 |
| | B | 158 | | | | | |
| | D | 79 | | | | | |
| 5 | A | 150 | −13(12) | −25.0(17.5) | 80 | small | 10/50 |
| | B | 150 | | | | | |
| 6 | A | 150 | −11(10) | −25.0(17.5) | 60 | large | 11/40 |
| | C | 150 | | | | | |
| 7 | B | 158 | −13(12) | −25.0(17.5) | 43 | small | 11/30 |
| | C | 79 | | | | | |
| 8 | B | 158 | −11(10) | −22.5(15) | 75 | small | 11/50 |
| | D | 79 | | | | | |
| 9 | B | 300 | −10(9) | −20.0(12.5) | 60 | large | 12/00 |
| 10(a) | F | 526 | −14(13) | −25.0(17.5) | 70 | large | 16/50 |

*AD.: Additive
(a): Comparative Example
ΔCFPP: CFPP depression
ΔP.P.: Pour Point depression
W.D.I.: Wax Dispersion Index
C.S.: Crystal Size
W.R.T.: Wax Redessolving Time

TABLE 4

Fuel II

| No. | AD.* | Amount (ppm) | CFPP* (ΔCFPP) (°C.) | P.P.* (ΔP.P.) (°C.) | W.D.I.* (%) | C.S.* | W.R.T.* (min/sec) |
|---|---|---|---|---|---|---|---|
| 11 | A | 63 | −16(13) | −27.5(15) | 31/69 | small | 11/54 |
| | B | 158 | | | | | |
| | C | 79 | | | | | |
| 12 | A | 63 | −19(16) | −30.0(17.5) | 13/87 | small | 11/34 |
| | B | 158 | | | | | |
| | D | 79 | | | | | |
| 13 | A | 150 | −16(13) | −27.5(15) | 50 | medium | 21/01 |
| | B | 150 | | | | | |
| 14 | A | 150 | −17(14) | −27.5(15) | 30/60 | medium | 12/40 |
| | C | 150 | | | | | |
| 15 | B | 200 | −17(14) | −27.5(15) | 35 | medium | 11/54 |
| | C | 100 | | | | | |
| 16 | B | 200 | −17(14) | −30.0(17.5) | 39 | large | 13/40 |
| | D | 100 | | | | | |
| 17 | B | 300 | −15(12) | −30.0(17.5) | 30 | large | 17/54 |
| 18 | D | 300 | −11(8) | −22.5(15) | 27 | small | 16/00 |
| 19(a) | F | 526 | −17(14) | −27.5(10) | 13/87 | large | 13/30 |

*AD.: Additive
(a): Comparative Example
ΔCFPP: CFPP depression
ΔP.P.: Pour Point depression
W.D.I.: Wax Dispersion Index
C.S.: Crystal Size
W.R.T.: Wax Redissolving Time The table 3 and 4 show that the nitrogen-containing polar compound is effective to improve fluidity and wax dispersion effects at lower temperature, and to reduce the size of the wax crystal of the diesel oils, when being used along with ethylene-vinyl acetate copolymer and/or dialkyl fumarate-vinyl acetate-butyl vinyl ether terpolymer.

What is claimed:

1. A petroleum fuel composition comprising a major amount of fuel oil and 0.002 to 4.0 wt % of an additive composition which comprises a compound of formula (I) together with a terpolymer alone or a terpolymer and a polymer having ethylene structure, wherein the terpolymer has a number average molecular weight of 1,000–5,000 and comprises 50–90 wt % of dialkyl fumarate made of monoalcohol having 1–24 carbon atoms and fumaric acid, 5–45 wt % of vinyl acetate and 5–45 wt % of butyl vinyl ether:

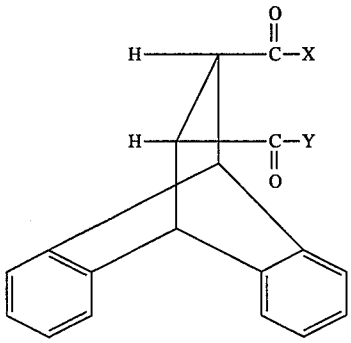

(I)

wherein, X is $NR_1R_2$ or $ONHR_3R_4R_5$ and Y is $NR_6R_7$ or $ONHR_8R_9R_{10}$ wherein $R_1$, $R_2$, $R_3$, $R_4$, $R_5$, $R_6$, $R_7$, $R_8$, $R_9$ and $R_{10}$ are hydrogen or straight chain alkyl group with 1–30 carbon atoms and they may be different or the same as each other, but all of them can not be hydrogen.

2. The petroleum fuel composition according to claim 1, wherein the terpolymer comprises 70–90 wt % of dialkyl fumarate made of monoalcohol having 4–18 carbon atoms and fumaric acid, 5–15 wt % of vinyl acetate and 5–15 wt % of butyl vinyl ether.

* * * * *